US009421812B2

(12) United States Patent
Jacobson et al.

(10) Patent No.: US 9,421,812 B2
(45) Date of Patent: Aug. 23, 2016

(54) THREE-RING BINDER WITH HOLE PUNCH

(71) Applicants: Dylan Jacobson, Waterloo, IA (US); Chase D. Wichert, Broken Arrow, OK (US)

(72) Inventors: Dylan Jacobson, Waterloo, IA (US); Chase D. Wichert, Broken Arrow, OK (US)

( * ) Notice: Subject to any disclaimer, the term of this patent is extended or adjusted under 35 U.S.C. 154(b) by 163 days.

(21) Appl. No.: 14/296,734

(22) Filed: Jun. 5, 2014

(65) Prior Publication Data

US 2014/0363215 A1 Dec. 11, 2014

Related U.S. Application Data

(60) Provisional application No. 61/831,192, filed on Jun. 5, 2013.

(51) Int. Cl.

| | |
|---|---|
| ***B42F 13/40*** | (2006.01) |
| ***B42F 3/04*** | (2006.01) |
| ***B26F 1/32*** | (2006.01) |
| *B26D 5/16* | (2006.01) |

(52) U.S. Cl.

CPC . *B42F 3/04* (2013.01); *B26F 1/32* (2013.01); *B42F 13/40* (2013.01); *B42F 13/402* (2013.01); *B26D 5/16* (2013.01)

(58) Field of Classification Search

CPC ..... B42F 13/40; B42F 13/404
USPC ..... 402/1, 70, 73
See application file for complete search history.

(56) References Cited

U.S. PATENT DOCUMENTS

| | | | | |
|---|---|---|---|---|
| 2,139,159 | A * | 12/1938 | Hammen | B42F 13/404 402/1 |
| 4,749,297 | A | 6/1988 | Roy | |
| 5,273,370 | A | 12/1993 | Bland et al. | |
| 5,409,319 | A | 4/1995 | Bedol | |
| 5,429,445 | A * | 7/1995 | Un-tae | B42F 13/404 402/1 |
| 6,261,020 | B1 | 7/2001 | Wyant | |
| 6,705,793 | B2 | 3/2004 | Wyant | |
| 2007/0086842 | A1 * | 4/2007 | Merzon | B42F 13/0026 402/73 |
| 2011/0305499 | A1 | 12/2011 | Lorenzen | |

FOREIGN PATENT DOCUMENTS

| | | | | |
|---|---|---|---|---|
| DE | 1097952 B | * | 1/1961 | B42F 13/404 |
| DE | 2751359 A1 | * | 5/1979 | B42F 13/404 |
| GB | 1531891 A | * | 11/1978 | B42F 13/404 |
| GB | WO 2008155577 A1 | * | 12/2008 | B42F 13/404 |
| IL | WO 2004052658 A1 | * | 6/2004 | B42F 13/404 |

OTHER PUBLICATIONS

DE 1097952 Translation (Jan. 1961).*

* cited by examiner

*Primary Examiner* — Kyle Grabowski
(74) *Attorney, Agent, or Firm* — Mckee, Voorhees & Sease, PLC

(57) ABSTRACT

A combination three-ring binder and hole punch is provided. The binder includes a housing upon which the rings are mounted and in which the punch assembly is mounted. A pivotal lever on the housing actuates the punch assembly which uses a slide cam to simultaneously punch three holes in one or more sheets of paper.

8 Claims, 8 Drawing Sheets

THREE-RING BINDER WITH HOLE PUNCH

CROSS-REFERENCE TO RELATED APPLICATIONS

This application claims priority under 35 U.S.C. §119 to provisional application Ser. No. 61/831,192 filed Jun. 5, 2013, herein incorporated by reference in its entirety.

BACKGROUND OF THE INVENTION

Three-ring binders for holding papers have been used in schools and businesses for many years. A three-hole punch machine is often used to simultaneously punch three holes in one or more sheets of paper which can then be stored in the three-ring binder.

Prior art is also known which combines the three-ring binder and the three hole punch machine into a single, integrated unit. For example, see U.S. Pat. Nos. 4,749,297; 5,273,370; 5,429,445; 5,409,319; 6,261,020; and 6,705,793, and published U.S. Application No. 2011/0305499. Each of these prior art combination binders and hole punch assemblies utilize manual downward force on a push button or arm to force the punch through the paper. This manual force can be difficult for young students or for people with physical hand impairments. Therefore, there is a need for an improved combination three-ring binder and hole punch which is easier to operate than the prior art devices.

Accordingly, a primary objective of the present invention is the provision of a three-ring binder having a lever actuated punch assembly for punching three holes simultaneously in one or more sheets of paper.

Another objective of the present invention is the provision of a three-ring binder with a built-in hole punch assembly which is easy to operate.

A further objective of the present invention is the provision of a three-ring binder with an integral hole punch mechanism and having a cavity for storing the punched-out paper pieces.

A further objective of the present invention is the provision of a three-ring binder having a clear protective cover, one or more storage bins, a moveable clear flap to house one or more pictures or photos, and/or a white erase board.

Still another objective of the present invention is the provision of a three-ring binder having a slide cam to actuate hole punchers.

Yet another objective of the present invention is the provision of a three-ring binder having hole punchers which are easily pulled upwardly to prevent jams.

A further objective of the present invention is the provision of a three-ring binder having a pivotal lever to actuate a hole punch mechanism.

These and other objectives will become apparent from the following description of the invention.

SUMMARY OF THE INVENTION

A three-ring binder and hole punch combination is provided for holding papers and supplies for school and work. The combination includes a punch assembly which is actuated by a lever to simultaneously punch three holes in one or more sheets of paper. The punch assembly includes a slide mechanism which forces the punches downwardly through the paper when the lever is actuated. When the slide mechanism is returned to the non-operative position, the punches are pulled upwardly to preclude jams. A storage compartment is provided in the punch assembly housing to catch the paper punches.

DETAILED DESCRIPTION OF THE PREFERRED EMBODIMENTS

Figure 1:
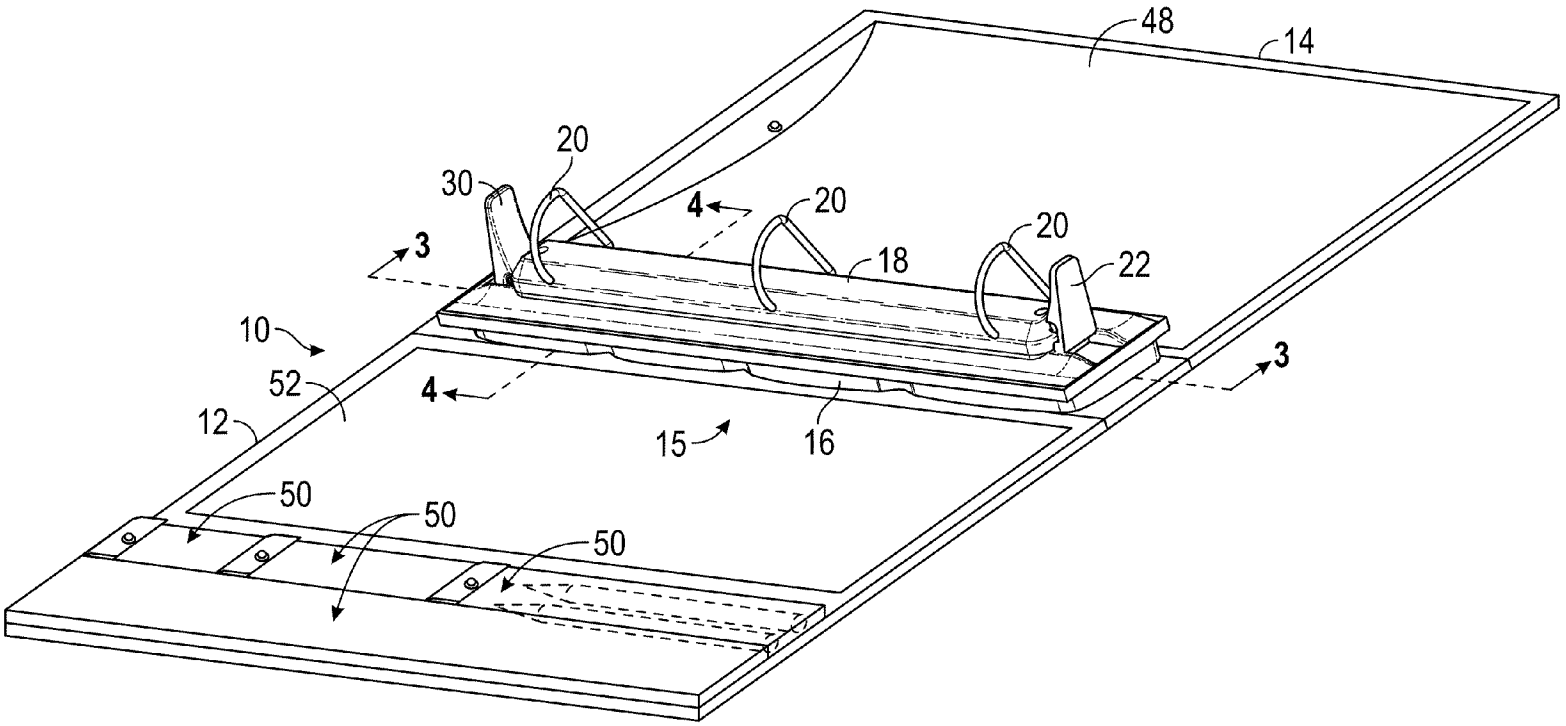
FIG. 1 is a perspective view of the three-ring binder and hole punch combination according to the present invention with the covers of the binder in an open position.
Figure 2:
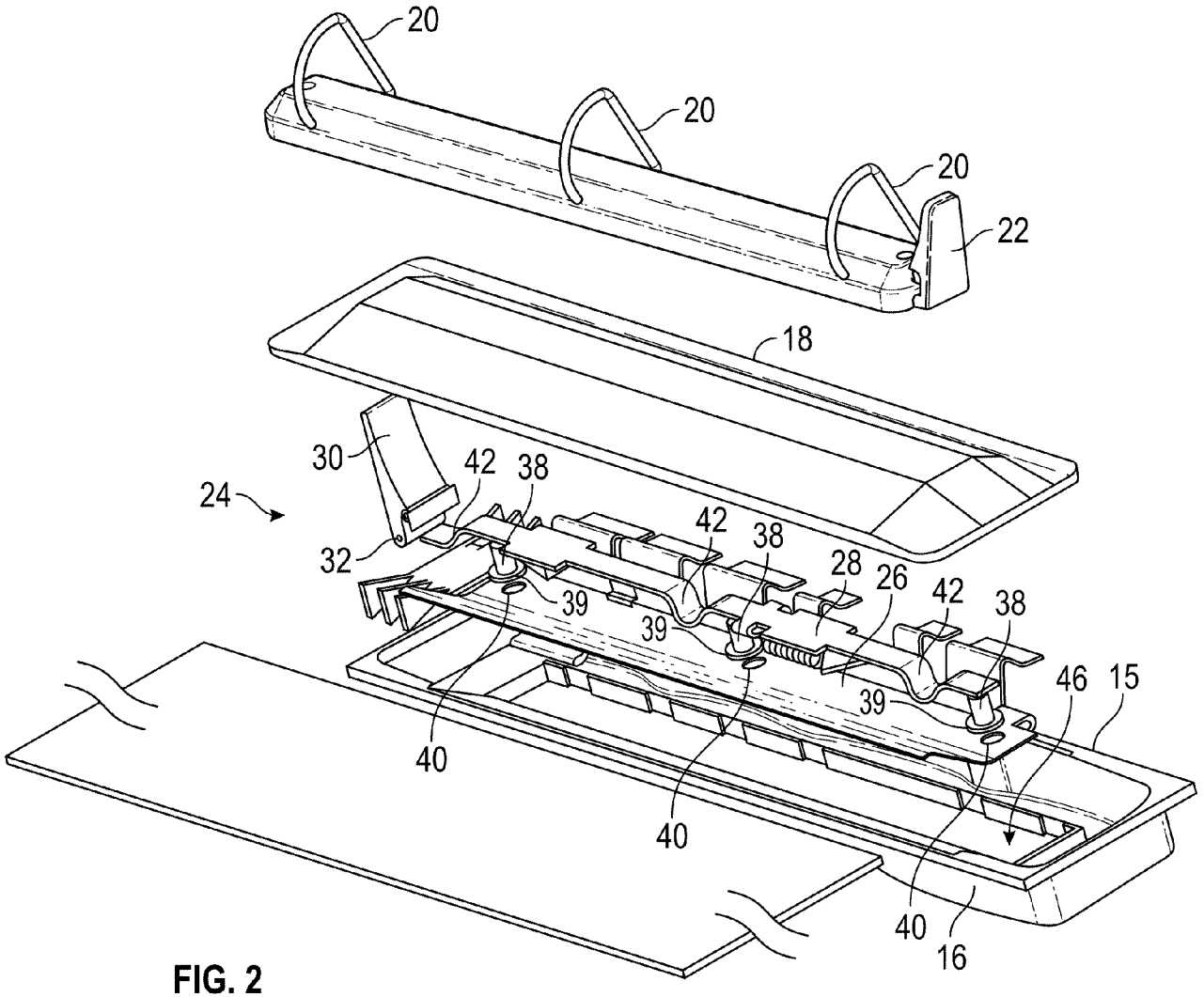
FIG. 2 is an exploded view of the punch assembly with the front and back binder covers removed for clarity.

In the drawings, the three-ring binder and hole punch combination of the present invention is generally designated by the reference numeral 10. The binder 10 includes front and back covers 12, 14, respectively, which can be moved between open and closed positions. The binder 10 includes housing 15 having a base 16, a cap 18 mounted on the base 16, and three-rings 20 for holding punched papers. The three-rings are mounted on the cap 18, and can moved from the closed position to an open position by a lever 22 pivotally mounted at one end of the cap 18, as is known in the art. The cap 18 may be fixed or removably mounted on the base 16.

Figure 3:
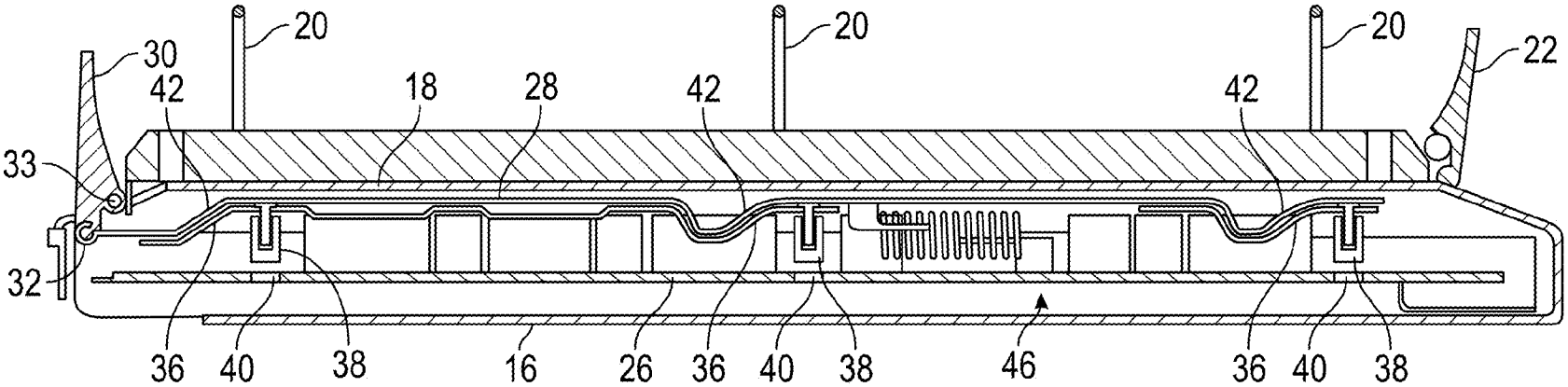
FIG. 3 is a sectional view of the punch assembly taken along line 3-3 of FIG. 1.
Figure 4:
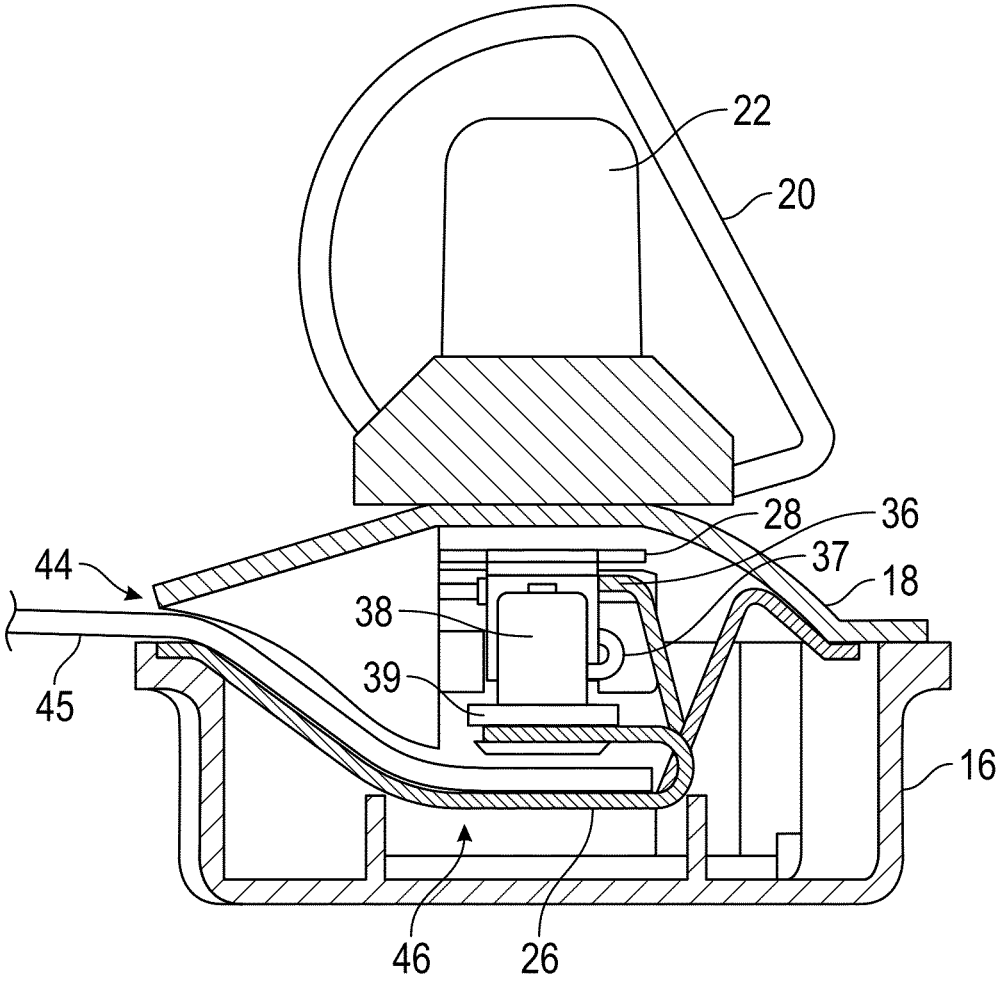
FIG. 4 is a sectional view of the punch assembly taken along lines 4-4 of FIG. 1.

A punch assembly 24 is mounted within the housing 15 between the base 16 and the cap 18. The punch assembly 24 includes a frame 26 with a bar 28 slidably mounted thereto. The bar 28 is longitudinally slidable relative to the frame 26. This sliding movement of the bar 28 is controlled by a lever 30 mounted opposite the lever 22 and pivotally connected to the bar 28 via a hinge 32 and pivotally connected to the housing cap 18 via pin 33, as seen in FIG. 3.

Figure 7:
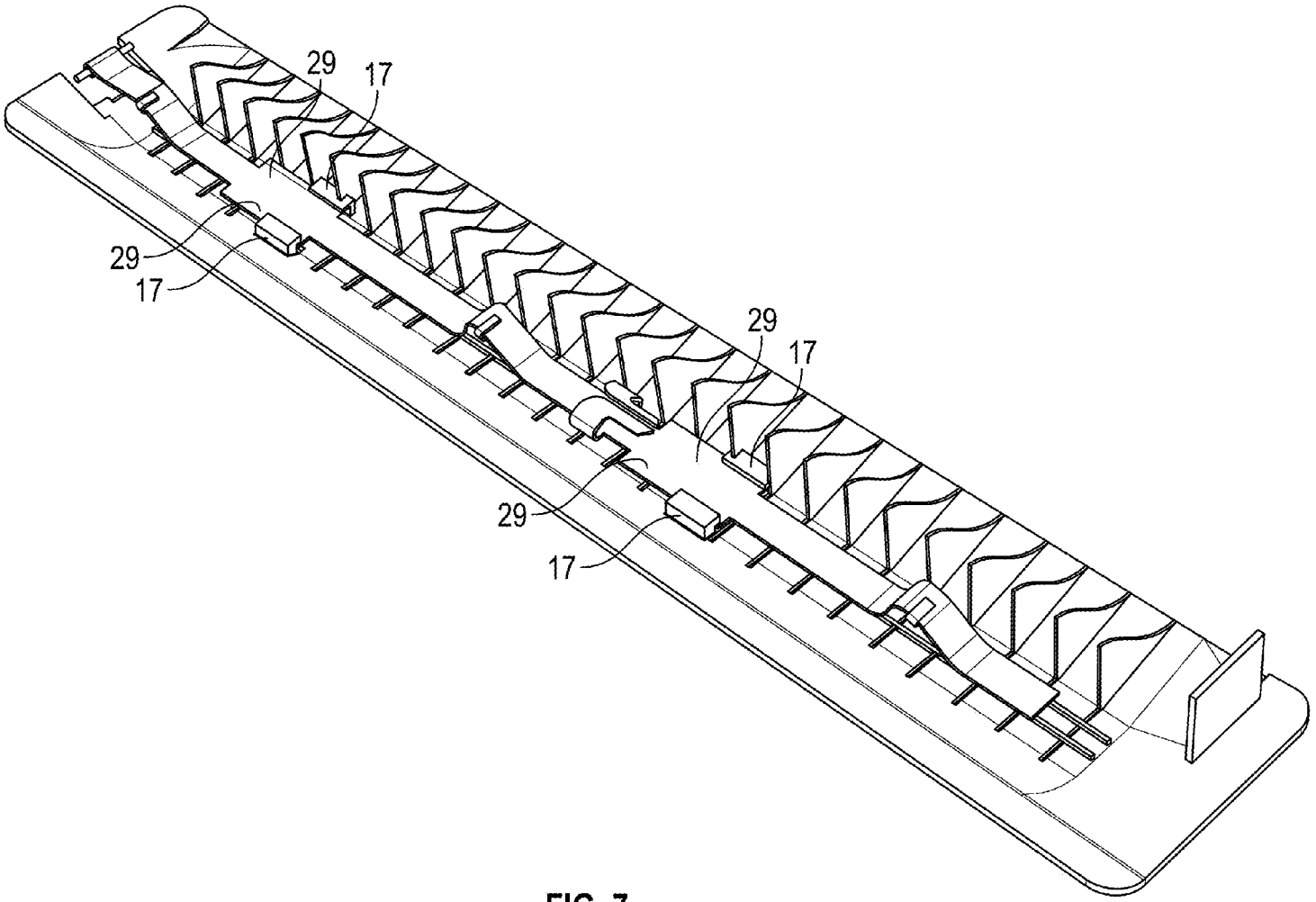
FIG. 7 is a perspective view of the base and slide bar of the punch mechanism.
Figure 8:
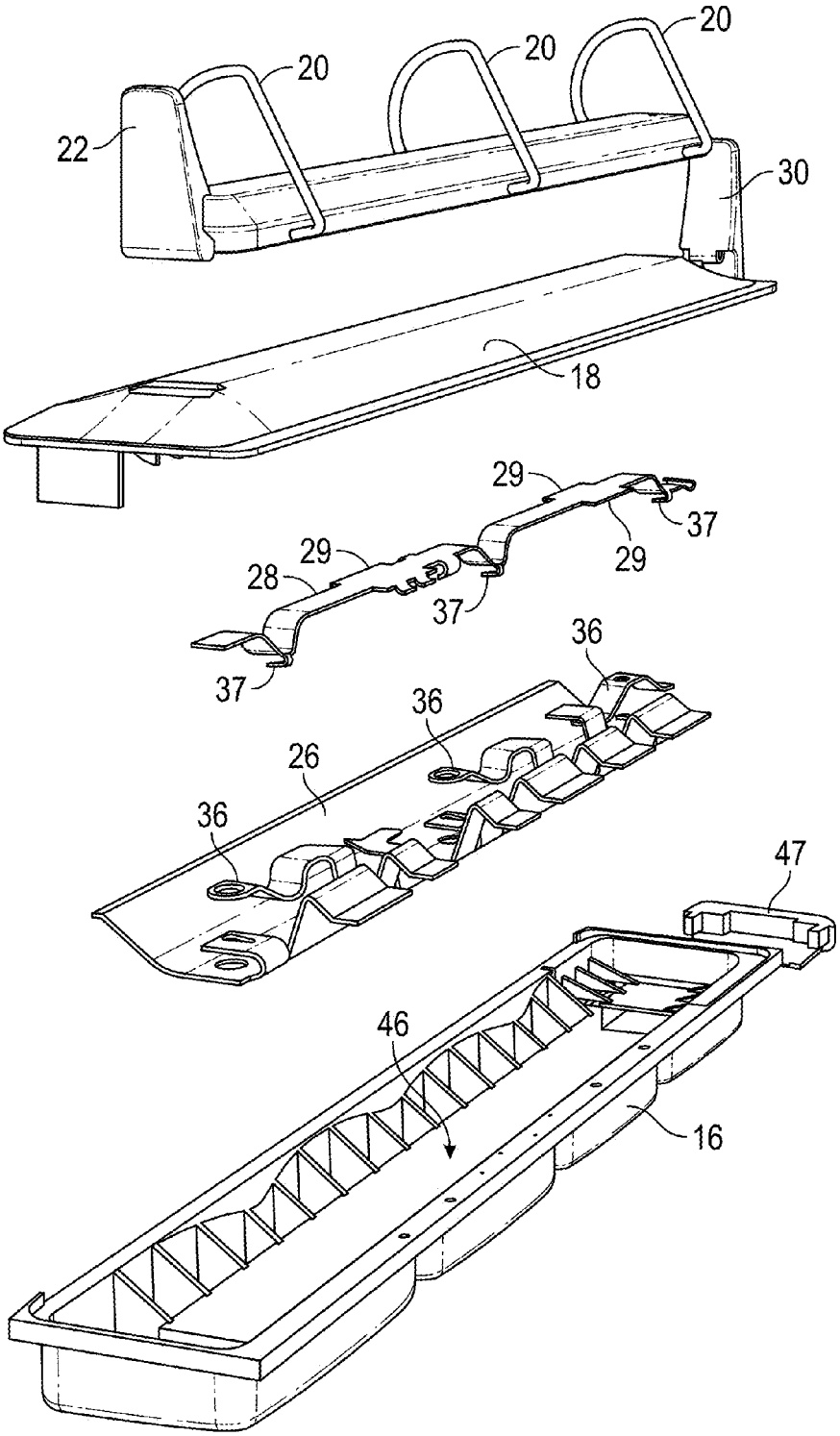
FIG. 8 is another exploded perspective view of the housing, ring clips, and punch mechanism.
Figure 9:
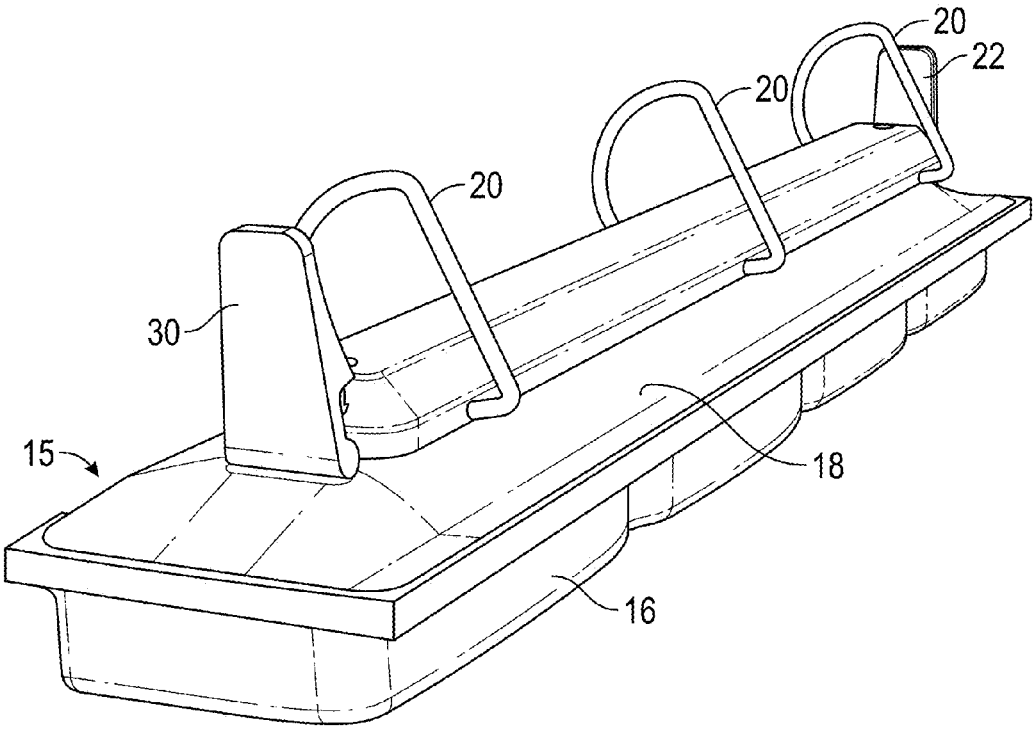
FIG. 9 is an assembled perspective view of the housing, rings, and actuation levers.

The base 16 guides or tracks the movement of the bar 28 between the neutral, non-operative position and the operative punch position. More particularly, the base 16 includes tabs 17 which overlie opposite side flanges 29 on the bar to help guide the sliding movement of the bar, as best seen in FIG. 7. The frame 26 has an elongated base plate 34 and three flexible or resilient fingers 36 residing beneath the bar 28. The slide bar 28 extends above the fingers 36, and is slidably coupled to the fingers 36 by clips 37. A paper punch 38 is mounted in a bushing 39 on each finger 36 and is adapted to move from a neutral position above the plate 34 to a punching position extending through a hole 40 in the plate 34.

Figure 5:
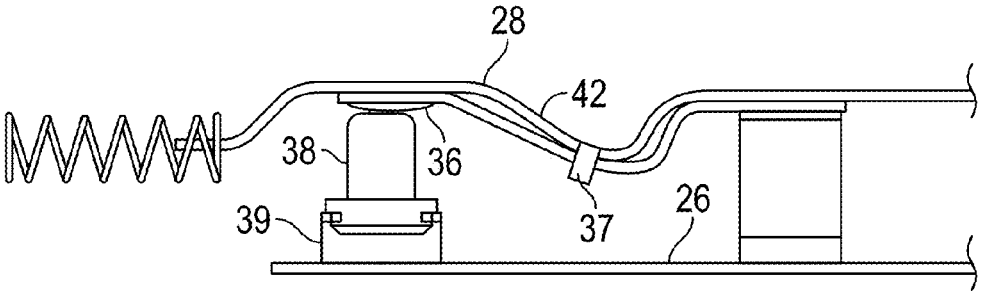
FIG. 5 is a side elevation view of the slide mechanism of the punch assembly in a non-operative position.
Figure 6:
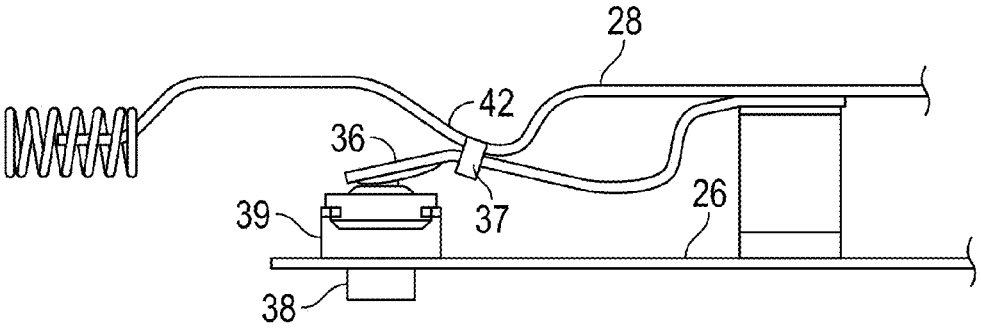
FIG. 6 is a view similar to FIG. 5 showing an operative hole-punching position of the slide mechanism.

The bar 28 includes three depressions or ramps 42. When the bar 28 is in a neutral position, the depressions or ramps 42 are slightly offset from the fingers 36 and paper punches 38, as seen in FIG. 5. When the lever 32 is actuated, the bar 28 slides longitudinally relative to the body 26 so as to engage the finger 36 and force the fingers 36 downwardly, which in turn, forces the paper punches 38 through the holes 40 and through paper 45 residing in the slot 44 within the punch assembly 24, as seen in FIG. 6. Thus, the paper 45 is punched by the sliding cam action of the bar 28, which aligns the ramps 32 with the paper punches 38. The punched out paper pieces are collected in the cavity 46 of the housing 15. A plug 47 may be removably mounted in one end of the base 16 and can be pulled out so that the residual paper punches can be emptied from the base 16. The clips 37 help pull the fingers 36 and punches 38 upwardly when the bar 28 is slid back to the neutral position by the lever 30 and thereby avoid jamming of the punch assembly 24.

The front and rear covers 12, 14 of the ring binder 10 may include one or more storage compartments. For example, the outside and/or inside of one or both of the covers may include a pocket with a clear protector 48 to receive an identification page, photograph, or other piece of paper. Storage compartments 50 can be formed in one of the covers, as shown in FIG. 1. Also, either or both of the covers may have a flap which can be opened to allow a photograph or other picture to be inserted, similar to the back of a picture frame. A white erase board 52 can also be provided on the inside or outside of either cover 12, 14.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A three-ring binder and hole punch combination for securing papers, comprising:

an elongated housing with three rings mounted thereon;

a punch assembly within the housing and aligned with the rings to punch three holes in paper;

the housing having a slot for receiving paper into the punch assembly;

an actuator lever pivotally mounted at one end of the housing and being operatively connected to the punch assembly to actuate the punch assembly and thereby simultaneously punch three holes in paper;

wherein the punch assembly includes a sliding bar which slides longitudinally within the housing between a neutral position and a hole punch position; and wherein the punch assembly further includes three resilient fingers which move up and down between a neutral position and a hole punching position in response to sliding movement of the bar.

2. The combination of claim 1 wherein the punch assembly includes three spaced apart punches movable between a raised non-operative position and a depressed operative position.

3. The combination of claim 1 wherein the sliding bar and the fingers are moved to the hole punch positions upon pivotal actuation of the lever.

4. The combination of claim 3 wherein the bar has three ramps which deflect the fingers downwardly when the lever is actuated.

5. The combination of claim 1 wherein the slide bar moves longitudinally within the housing and along the fingers to depress the punches and force the punches through a piece of paper.

6. The combination of claim 1 wherein the slide bar is clipped to the fingers for guided movement along the fingers.

7. The combination of claim 1 further comprising a receptacle within the housing to collect material punches from the paper.

8. The combination of claim 1 wherein the binder includes at least one storage compartment for writing tools, a dry erase board, and a photograph compartment with a clear cover.

* * * * *